United States Patent [19]

Giguere

[11] Patent Number: 4,702,050

[45] **Date of Patent: * Oct. 27, 1987**

[54] CASING WINDOW

[75] Inventor: Jean-Paul Giguere, Lotbiniére, Canada

[73] Assignee: Donat Flamand, Inc., Quebec, Canada

[ * ] Notice: The portion of the term of this patent subsequent to Dec. 2, 2003 has been disclaimed.

[21] Appl. No.: 884,906

[22] Filed: Jul. 14, 1986

Related U.S. Application Data

[63] Continuation-in-part of Ser. No. 631,101, Jul. 16, 1984, Pat. No. 4,625,479.

[30] Foreign Application Priority Data

Jun. 27, 1984 [CA] Canada ..... 457546

[51] Int. Cl.[4] ..... E06B 7/12; E06B 3/58

[52] U.S. Cl. ..... 52/202; 52/203; 52/775; 52/766

[58] Field of Search ..... 52/202, 203, 208, 772, 52/766, 775

[56] References Cited

U.S. PATENT DOCUMENTS

| | | | |
|---|---|---|---|
| 2,642,632 | 6/1953 | Savage | 52/775 X |
| 3,698,148 | 10/1972 | Marantier | 52/775 X |
| 3,858,377 | 1/1975 | Browne et al. | 52/775 |
| 3,964,225 | 6/1976 | Yoshida | 52/766 |
| 3,971,178 | 7/1976 | Mazzoni et al. | 52/203 X |
| 4,625,479 | 12/1986 | Giguere | 52/202 |

FOREIGN PATENT DOCUMENTS

| | | | |
|---|---|---|---|
| 2334802 | 1/1974 | Fed. Rep. of Germany | 52/775 |

*Primary Examiner*—William F. Pate, III
*Assistant Examiner*—R. E. Chilcot
*Attorney, Agent, or Firm*—Cushman, Darby & Cushman

[57] ABSTRACT

A system for mounting a relatively thick multiple glazed sealed unit to a wooden sash assembly of a standard thickness. The system comprises a peripheral base member inserted between the glazed unit and the sash of the window and a retaining moulding engaged to the peripheral base member and pressing the glazed unit in the sash to hold it in place. A suitable weather strip is applied between the glazed unit and the retaining moulding to prevent air infiltration.

3 Claims, 3 Drawing Figures

CASING WINDOW

This is a continuation-in-part application of Ser. No. 631,101, filed July 16, 1984, now U.S. Pat. No. 4,625,479.

FIELD OF THE INVENTION

The present invention relates to a device for mounting a relatively thick multiple glazed sealed unit in a wooden sash having a normal thickness.

BACKGROUND OF THE INVENTION

Ordinary double glazed sealed units normally have a thickness of approximately 20 mm. When better thermal protection is required, thick triple glazed sealed units may be used, which feature air spaces of about 12 mm each. These triple glazed units present excessive thickness for use in normal sashes having a 20 mm rabbet.

As used herein, the term "thick multiple glazed units" designates a sealed glazing assembly of at least two glass panes spaced relative to each other and forming an insulating units having a thickness in the 30 to 40 mm range, and adapted to be mounted in a sash. This expression includes triple glazed units comprising two air spaces of 13 mm each. This particular triple glazed unit turns out to be very efficient and it is increasingly popular. It has a thickness of approximately 38 mm.

With the increasing heating costs, thermal insulation of dwellings has become a major preoccupation. Air infiltration through windows must be reduced, and glass units of improved thermal efficiency are required. Double glazed units have become quite popular but triple glazed units are now generating more than a passing interest due to the increase of heating costs. In recent years, the use of triple glazed units has been in substantial demand in areas of harsh climates.

Thick multiple glazed units, including triple glazed units featuring 13 mm air spaces, provide the required degree of thermal insulation but their excess thickness creates a very serious problem due to insufficient space in the sashes and in the window frames of ordinary construction. For instance, thick triple glazed units do not fit in double glazed sashes on account of insufficient rabbet depth, and this is also true for the jamb. This problem becomes particularly acute in the case of casing windows when room is required to accommodate the swinging of the sash around its hinges. Increasing the sash thickness will result in complete inoperativeness of the window since the sash could not pivot in the jamb.

Thus, one may use thin triple glazed units having two air spaces of reduced thickness as this allows them to be mounted in a sash having a normal thickness, in the usual manner. However, from the standpoint of thermal efficiency, such a solution defeats the main purpose of the change because it greatly reduces the insulation expected of triple glazed units. Such "thin" triple glazing is not really very superior to the usual double glazed units.

OBJECTS AND STATEMENT OF THE INVENTION

A main object of the present invention is to provide a window, having a thick glazed unit mounted in a normal sash.

Another object of this invention is to provide a retaining device for mounting a thick sealed glazed unit in a window sash or a door frame, which device can be easily manufactured and used.

In accordance with this invention, these objects are achieved by using a jaw inserted between the glazed unit and the sash of the window pane and also a retaining moulding progressively engageable in a one-way direction in the jaw, to immobilize the glazed unit in the sash.

Thus, the system herein describes a multiple sealed glazed unit mounted to a wooden sash that includes an L-shaped seat of a standard depth. This seat is edged laterally by a peripheral shoulder against which bears the glazed unit and the thickness of the latter is greater or substantially equal as compared to the depth of the seat. A retaining device comprises a peripheral base member adapted to be engaged to the sash and inserted between the glazed unit and the sash and a removable peripheral retaining moulding adapted to be engaged in the base member and pressing the glazed unit against the shoulder to hold the glazed unit in the sash. This retaining moulding is adapted to be engaged in the base member by means of a ratchet-stop allowing a progressive notch engagement of the retaining moulding but preventing any backward motion or unwanted withdrawal.

Other possible applications of the present invention will be obvious from the detailed description of a preferred embodiment of the invention which will be given hereinafter by referring to the accompanying drawings in which:

DESCRIPTION OF A PREFERRED EMBODIMENT

Figure 1:
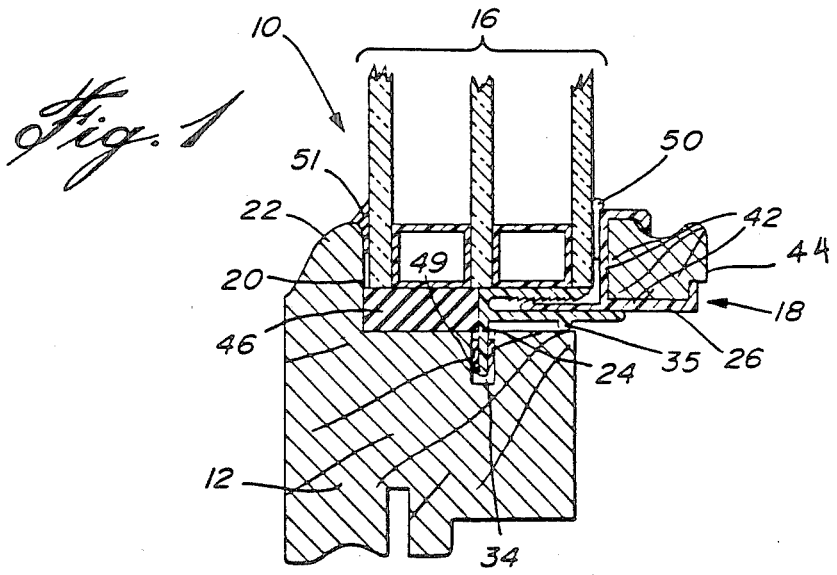
FIG. 1 is a horizontal sectional view of a portion of a leaf of a window displaying one of the stiles of the sash and a portion of the triple glazed unit.

The portion of the window illustrated in FIG. 1, generally indicated by the reference 10, is a horizontal sectional view illustrating a stile of a sash of a sealed triple glazed window. The window comprises a wooden sash 12, a multiple glazed sealed unit 16 and a retaining device 18 holding the glazed unit 16 to the sash 12. The latter comprises an L-shaped seat 20 receiving the glazed unit 16 therein and including a shoulder portion or peripheral stop 22 against which the glazed unit 16 rests. This shoulder portion 22 is integral with the sash 12. The sash 12 has a standard thickness, for example, approximately 45 mm; the depth of the seat 20 is about equal or smaller as compared to the thickness of the glazed unit 16 (approximately 38 mm). Sashes of this kind are commonly used on the North American market.

The retaining device 18 is constituted by a peripheral base member 24, preferably an extrusion of plastic material, following the perimeter of the glazed unit 16, and by a peripheral retaining moulding 26, also an extrusion of plastic material. The retaining device 18 is engaged to the base member 24 and serves to press the glazed unit against the shoulder 22 to hold it in the sash 12.

Figure 2:
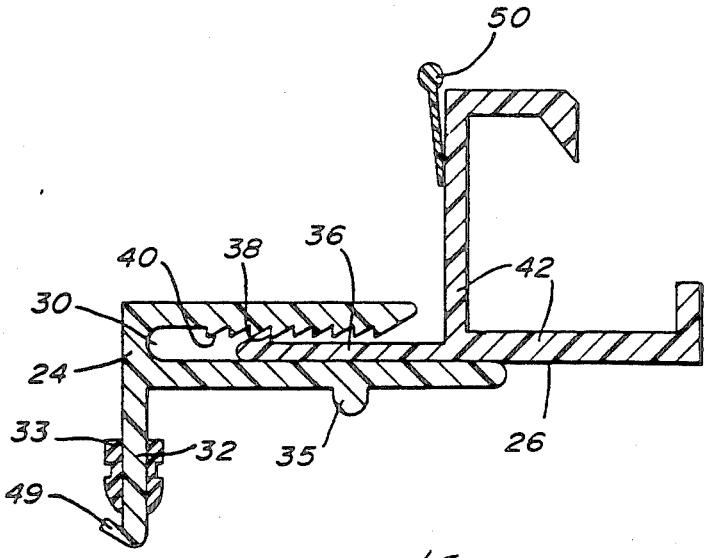
FIG. 2 is a sectional view of the retaining device according to the present invention.

Referring to FIG. 2, which illustrates a preferred embodiment of the retaining device according to the invention, the base member 24 comprises a jaw 30, having on the inner side of one of its opposite branches, a set of tiny teeth 40. The base member 24 is supported to the sash 12 by means of a longitudinal flange 32 penetrating a groove 34 (see FIG. 1) made on the rabbet of the sash 12. The flange 32 is secured in the groove 34 by means of resilient fins 33 pressing against the wall of the groove 34. Further, a hook 49 mounted on the extremity of the flange 32 stabilizes the base member 24. The latter also comprises a rib 35 pressing on the edge of the sash 12, which swings the jaw 30 and the retaining moulding 26 against the glazed unit 16 increasing pressure on the latter.

The retaining moulding 26 comprises a tongue 36 carrying at its extremity a pawl 38 engaging the back of teeth 40 of the jaw 30. At the other extremity are mounted two diverging wings 42 holding an ornamental moulding 44. When the tongue 36 penetrates the jaw 30, the pawl 38 engages the back of teeth 40 of the jaw 30 to form a progressive notch ratchet-stop. Thus, when the retaining moulding 26 is engaged in the jaw 30, the glazed unit 16 is clamped in the sash 12 between the shoulder portion 22 and the retaining moulding 26. The presence of a plurality of teeth 40, very fine and slightly spaced, allows an engagement at different positions of the retaining moulding 26 in the jaw 30. This system can receive and accommodate glazed units having different thicknesses. It further allows to hold the glazed unit with more or less pressure, by tightening the weather stripping 50 against the internal glass pane.

For the installation of the glazed unit 16, a peripheral rubber band 46 may be installed in seat 20 to provide additional engagement to the glazed unit 16.

The imperviousness between the glazed unit 16 and the sash 12 is achieved by using a plastic sealer 51 and a rubber stripping 50.

In a preferred embodiment of the invention, the sash has a thickness of 35 mm and the glazed unit has a thickness of 38 mm. In another embodiment, the sash has a thickness of 45 mm.

Figure 3:
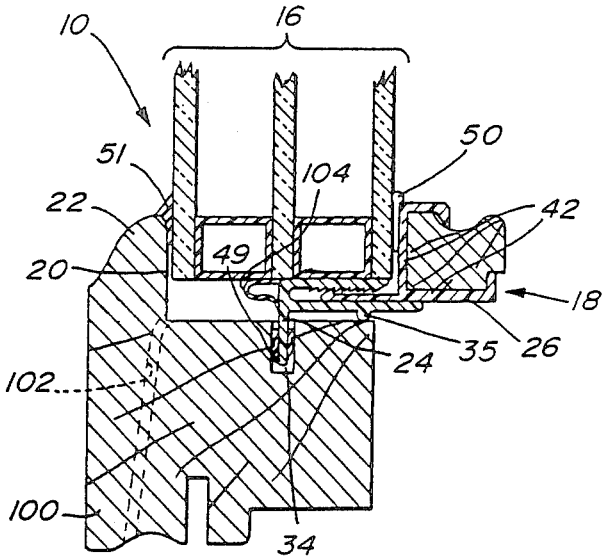
FIG. 3 is a vertical sectional view of the retaining device according to the present invention, provided with an additional seal.

The sash of a typical casing window comprises a pair of upright which are connected at their upper ends by a sash head member and are joined at their lower ends by a sash sill member 100, shown in cross-section in FIG. 3. In certain cases, it is preferable to provide the sash sill member 100, with a series of drain openings 102 which are generally vertical, through which condensation which may accumulate in the L-shaped seal 20, may be evacuated.

However, in regions where the climate is harsh, openings 102 may be the source of air infiltration when the rubber stripping 50 is worn out and cannot garantee an adequate imperviousness. Thus, cold air may penetrate between the glazed unit 16 and the upper surface of the peripheral base member 24 to pass subsequently through the rubber stripping 50.

To avoid such infiltration, the peripheral base member 24 may be provided with an additional seal 104. Seal 104 is constituted by a strip of flexible and supple material having a pair of longitudinal parallel edges attached permenently to base member 24 to define a weather strip which extends along base member 24 and follows peripherally the glazed sealed unit 16. Seal 104 is applied against the glazed unit 16 to prevent air infiltration and confines a volume of air for reducing the heat transfer.

When the peripheral base member 24 is provided with a seal 104, the peripheral rubber band 46, shown in FIG. 1 is omitted.

The invention will now be defined in the following claims and it is well understood that the preferred embodiment described above may be modified in its secondary aspects without altering the gist of the invention.

What is claimed is:

1. A device for holding a multiple glazed sealed unit in a wooden sash having a rabbet, said glazed unit having a given uniform thickness, said sash defining an L-shaped seat receiving said glazed unit therein, said seat having a given uniform depth and being edged laterally by a shoulder portion which determines the depth of said seat and against which bears said glazed unit, the thickness of said glazed unit being no less than the depth of said seat, said device comprising:

a peripheral base member adapted to be inserted between said glazed unit and said sash, said peripheral base member being retained on said sash;

a removable peripheral retaining moulding, adapted to be engaged in the peripheral base member and pressing the glazed unit against the shoulder of the seat to hold said glazed unit in said sash, said peripheral retaining moulding being adapted to be engaged in said peripheral base member by means of a ratchet-stop allowing a progressive notch engagement of said peripheral retaining moulding in said peripheral base member but prevent unwanted withdrawal of said peripheral retaining moulding relative to said peripheral base member;

said peripheral base member being constituted by a jaw having two branches, one of which comprises on its inner side a set of teeth, said peripheral retaining moulding comprising a tongue substantially perpendicular to the plane of said sash, said tongue penetrating said base member and comprising, at one end, a pawl engaging the backside of said teeth in order to form said ratchet-stop;

said peripheral base member being retained on said sash by means of a longitudinal flange extending substantially at right angles relative to said base member, said flange penetrating and being held in a peripheral groove formed in said rabbet of said sash, said peripheral groove being spaced from said shoulder portion of said sash a predetermined distance;

said sash comprising a pair of uprights connected at their upper extremities by a sash head member and connected at their lower extremities by a sash sill member with said sash sill member having a wall spaced from said multiple glazed sealed unit to define an elongated chamber, said sash sill member comprising at least one drainage opening, said device further comprising a peripheral seal mounted to said peripheral base member and extending partially into said chamber with said seal being disposed to contact said multiple glazed sealed unit.

2. A device as defined in claim 1, wherein said seal confines a volume of air.

3. A device for holding a multiple glazed sealed unit in a wooden sash having a rabbet, said glazed unit having a given uniform thickness, said sash defining an L-shaped seat receiving said glazed unit therein, said seat having a given uniform depth and being edged laterally by a shoulder portion which determines the depth of said seat and against which bears said glazed unit, the thickness of said glazed unit being greater or no less than the depth of said seat, said device comprising:

a peripheral base member adapted to be inserted between said glazed unit and said sash, said peripheral base member being retained on said sash;

a removable peripheral retaining moulding, adapted to be engaged in the peripheral base member and pressing the glazed unit against the shoulder of the seat to hold said glazed unit in said sash, said peripheral retaining moulding being adapted to be engaged in said peripheral base member by means of a ratchet-stop allowing a progressive notch engagement of said peripheral retaining moulding in said peripheral base member but prevent unwanted withdrawal of said peripheral retaining moulding relative to said peripheral base member;

said peripheral base member being constituted by a jaw having two branches, one of which comprises on its inner side a set of teeth, said peripheral retaining moulding comprising a tongue substantially perpendicular to the plane of said sash, said tongue penetrating said base member and comprising, at one end, a pawl engaging the backside of said teeth in order to form said ratchet-stop;

said peripheral base member being retained on said sash by means of a longitudinal flange extending substantially at right angles relative to said base member, said flange penetrating and being held in a peripheral groove formed in said rabbet of said sash, said peripheral groove being spaced from said shoulder portion of said sash a predetermined distance;

said sash comprising a pair of uprights connected at their upper extremities by a sash head member and connected at their lower extremities by a sash sill member with said sash sill member having a wall spaced from said multiple glazed sealed unit to define an elongated chamber, said sash sill member comprising at least one drainage opening, said device further comprising a peripheral seal mounted to said peripheral base member and extending partially into said chamber with said seal being disposed to contact said multiple glazed sealed unit;

said sash further comprising a pair of uprights connected at their upper extremities by a sash head member and connected at their lower extremities by a sash sill member, said sash sill member comprising at least one drainage opening, said device further comprising a peripheral seal mounted to said peripheral base member and extending therealong, said seal being adapted to contact said multiple glazed sealed unit;

said seal confining a volume of air and being made of a relatively supple and flexible material.

* * * * *